US005960486A

United States Patent [19]

Huliganga

[11] Patent Number: 5,960,486

[45] Date of Patent: Oct. 5, 1999

[54] FAUCET-LIKE BIDET ATTACHMENT

[76] Inventor: Eddie F. Huliganga, 13935 Locke La., Houston, Tex. 77077

[21] Appl. No.: 08/971,200

[22] Filed: Nov. 14, 1997

Related U.S. Application Data

[60] Provisional application No. 60/045,978, May 8, 1997.

[51] Int. Cl.[6] ..... E03D 9/08

[52] U.S. Cl. ..... 4/447; 4/420.4

[58] Field of Search ..... 4/420.2, 420.4, 4/447, 444

[56] References Cited

U.S. PATENT DOCUMENTS

| | | | |
|---|---|---|---|
| 4,181,985 | 1/1980 | Rius | 4/420.4 X |
| 4,953,238 | 9/1990 | Shifferly | 4/420.4 X |
| 5,023,961 | 6/1991 | Alonso | 4/420.4 X |
| 5,384,919 | 1/1995 | Smith | 4/420.4 X |
| 5,452,483 | 9/1995 | Dizon | 4/420.4 X |

*Primary Examiner*—Charles E. Phillips
*Attorney, Agent, or Firm*—Kenneth A. Roddy

[57] ABSTRACT

The present invention provides a simple faucet-like bidet attachment which is connected to existing hot water and cold water supply lines adjacent to a conventional flush toilet. The bidet device has a control valve and a pliant S-shaped water conduit that extends from the control valve under the toilet seat, curves over the rim of the toilet bowl, then extends downwardly, and then curves back upwardly in the bowl. A spray nozzle attached to the upwardly extending free end of the conduit produces a comfortable bidet spray directed to the target area. The pliant S-shaped conduit is easily adjusted according to each user's particular preferences, by simply bending or shaping it by hand. The control valve regulates the water pressure and temperature that flows through the S-shaped water conduit, and in a preferred embodiment, provides hot, warm, or cold water temperature settings.

8 Claims, 3 Drawing Sheets

FAUCET-LIKE BIDET ATTACHMENT

This appln claims the benefit of prov. appln No. 60/045978 filed May 8, 1997.

BACKGROUND OF THE INVENTION

1. Field of the Invention

This invention relates generally to bidet devices for cleansing the anal and genital areas of the human body, and more particularly to a simple, useful, cost-effective, and affordable faucet-like bidet device for use in conjunction with a conventional flush toilet.

2. Brief Description of the Prior art

Hygienic cleansing devices, more specifically bidets, are well known in many parts of the world. Their worldwide acceptance, as part of personal hygiene are promising. The concept of bidets is relatively old, going back at least as early as 1881, in U.S. Pat. No. 244,219.

Bidets are typically a stand-alone bathroom fixture, having substantially the same size and configuration as an ordinary flush toilet, with hot and cold water taps for producing a relatively comfortable temperature for cleansing purposes. In some cases, nozzles or spray heads are provided to direct the flow of water to the desired area to be cleansed.

Notwithstanding their positive contribution to personal hygiene, however, bidets have failed to significantly impact widespread acceptance, locally and internationally. Space constraints may preclude the installation of a bidet in many existing bathrooms. Bidets often represent an additional plumbing fixture and thus a substantial expense is involved that some prospective consumers may find difficult to justify.

Most conventional bidets, are typically bulky and awkward to use, and require special plumbing to install. As a result, although the use of bidets are popular, where they are available, because of their complexity and unsightly appearance, they have not become popular or commercially available. The lack of practicality, maybe the bottom line of consumers' passive attitude towards this remarkable device.

There are several patents which disclose various bidet devices and apparatus. However, most of these devices are characterized by an undue level of mechanical complexity, which may affect their reliability and preclude their economical manufacture and widespread acceptance. Existence of complicated water supply conduits and mechanical arrangements are also common undesirable features of the prior art.

Ibel, U.S. Pat. No. 4,145,767 and Broyles, U.S. Pat. No. 4,876,750 disclose composite water closet and bidet fixtures which are stand-alone plumbing fixtures that would replace the conventional toilet.

Huck et al, U.S. Pat. No. 4,406,025 discloses a bidet device having an elongated vertical water heater storage vessel with a bottom inflow cold water connection and a top outflow connection to the bidet attachment, that serves as the source for the warm water supply. Although it takes advantage of the toilet bowl for use as the bidet basin, there are a number of shortcomings in other respects. For example, the water heater storage vessel is an additional large fixture requiring additional space and adding to the cost, as well as additional maintenance costs that will be incurred later on. The existence of a bidet tube support assembly adds another unnecessary feature and only contributes more to its complexity.

Nourbakhsh, U.S. Pat. No. 4,596,058 discloses a water closet bidet system having a hand held spray device which can be retracted into a compartment for storage. The need to use at least one hand during its operation is obviously an unwanted feature for users especially the handicapped. This awkward procedure, which results in considerable inconvenience for users, is totally eliminated by the present invention.

Latora, U.S. Pat. No. 5,271,104 discloses a toilet bidet attachment having a hose that attaches to the toilet filler tube and may include an electric heater. The device has a rigid bidet arm that merely pivots to one side.

Lesick, U.S. Pat. No. 4,195,369 discloses a removable toilet bidet attachment in the form of a two-piece clamp that attaches to the rim of the toilet bowl and has a nozzle body fixed onto the clamp body and connected with fluid passageways. The nozzle body is only pivotally adjustable about a horizontal axis.

Smith, U.S. Pat. No. 5,384,919 discloses a bidet attachment that is secured to the underside of a toilet seat and has an elongated rigid water pipe with an upwardly directed nozzle and a lever. The water pipe is only pivotal about a horizontal axis.

McGuire, U.S. Pat. No. 5,495,625 discloses a toilet bowl bidet attachment which has a rigid tube which extends through an aperture formed in the toilet bowl. This device requires drilling a hole through the wall of the toilet bowl.

Chandler, U.S. Pat. No. 5,504,948 discloses a bidet attachment and valve arrangement that is built into a toilet seat and has a rigid bidet arm that merely pivots to one side.

The foregoing patents demonstrate the failure to provide a bidet device of simple construction, installation and operation.

The present invention is distinguished over the prior art in general, and these patents in particular by a simple faucet-like bidet attachment which is connected to existing hot water and cold water supply lines adjacent to a conventional flush toilet. The bidet device has a control valve and a pliant S-shaped water conduit that extends from the control valve under the toilet seat, curves over the rim of the toilet bowl, then extends downwardly, and then curves back upwardly in the bowl. A spray nozzle attached to the upwardly extending free end of the conduit produces a comfortable bidet spray directed to the target area. The pliant S-shaped conduit is easily adjusted according to each user's particular preferences, by simply bending or shaping it by hand. The control valve regulates the water pressure and temperature that flows through the S-shaped water conduit, and in a preferred embodiment, provides hot, warm, or cold water temperature settings. Alternatively, the control valve may provide hot and cold water, or just cold water.

SUMMARY OF THE INVENTION

Accordingly, it is therefore an object of the present invention to provide a simple, efficient, and economical approach to personal hygiene and a cleansing process that is totally hands free.

It is another object of this invention to provide a faucet-like bidet device having a pliant S-shaped water conduit and a nozzle at one end that is easily shaped or bent by hand to the particular preferences of each user and freely-adjustable within a concentrated area to properly and selectively position the nozzle.

Another object of this invention is to provide a faucet-like bidet device which conserves space and utilizes existing hot and cold water connections as well utilizing the toilet bowl as a bidet basin.

Another object of this invention is to provide a simple and affordable bidet device that connects easily and quickly to existing hot and cold plumbing connections and has an easily maneuverable S-shaped bidet water conduit and does not require unnecessary attachments or support.

Another object of this invention is to provide a bidet device which is controlled with a simple simple faucet-like open and close operation.

A further object of this invention is to provide a bidet device having a control valve that allows the user to select three preset water temperature selections, e.g., hot, warm, and cold, and prevent abrupt and uncomfortable water temperature changes during the time of usage and/or at the start of each use.

A still further object of this invention is to provide a bidet device having a nozzle assembly which will neutralize the water pressure so as to provide additional comfort to the bidet user.

Other objects of the invention will become apparent from time to time throughout the specification and claims as hereinafter related.

The above noted objects and other objects of the invention are accomplished by a the present simple faucet-like bidet attachment which is connected to existing hot water and cold water supply lines adjacent to a conventional flush toilet. The bidet device has a control valve and a pliant S-shaped water conduit that extends from the control valve under the toilet seat, curves over the rim of the toilet bowl, then extends downwardly, and then curves back upwardly in the bowl. A spray nozzle attached to the upwardly extending free end of the conduit produces a comfortable bidet spray directed to the target area. The pliant S-shaped conduit is easily adjusted according to each user's particular preferences, by simply bending or shaping it by hand. The control valve regulates the water pressure and temperature that flows through the S-shaped water conduit and in a preferred embodiment, provides hot, warm, or cold water temperature settings. Alternatively, the control valve may provide hot and cold water, or just cold water.

DESCRIPTION OF THE PREFERRED EMBODIMENTS

Figure 1:
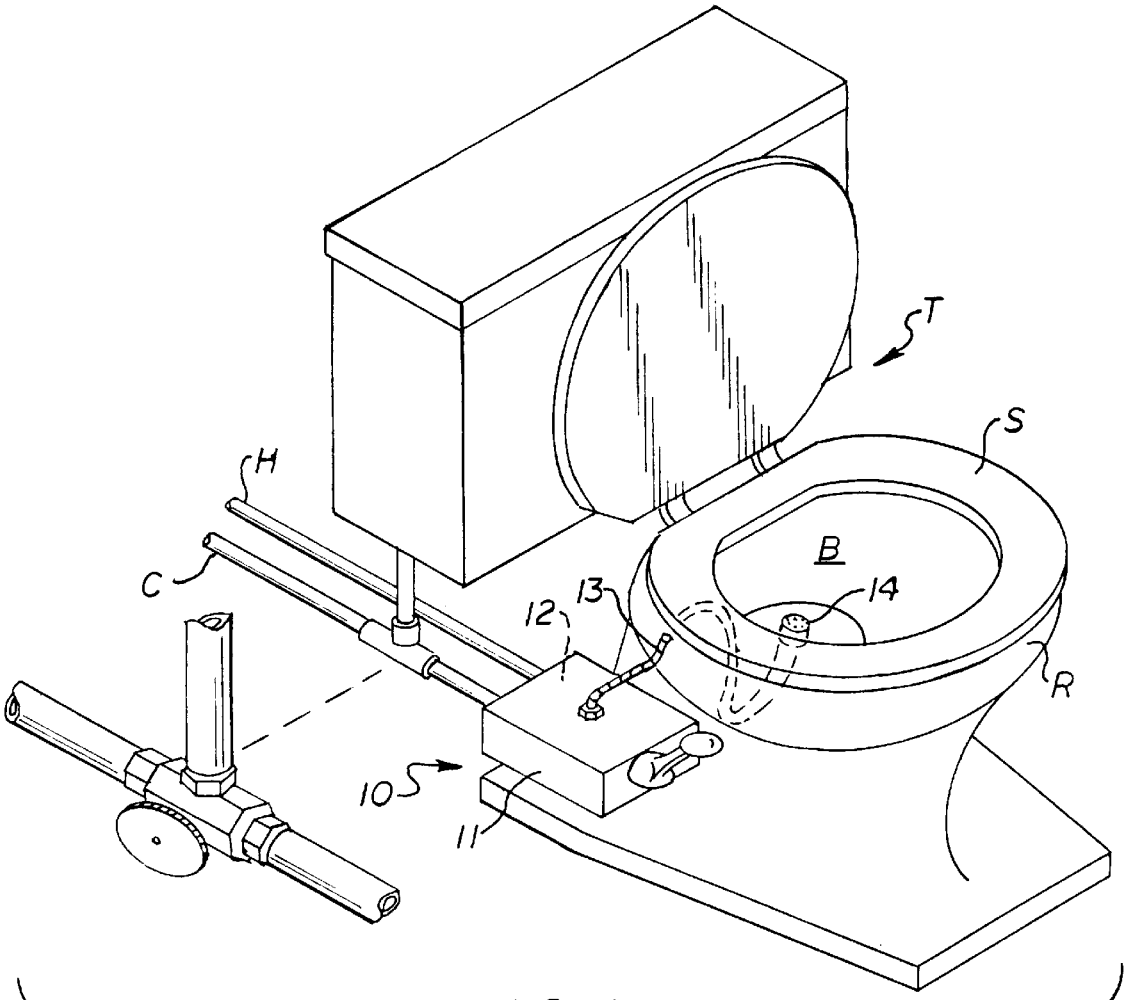
FIG. 1 is a perspective view of a preferred embodiment of a bidet device in accordance with the present invention shown installed adjacent to an existing conventional flush toilet fixture.

Referring to the drawings by numerals of reference, there is shown in FIGS. 1, 2, 3, and 4, a preferred bidet attachment device 10 in accordance with the present invention for use in connection with a conventional flush toilet T. The bidet device 10 has a faucet-like control valve 12 which may be enclosed inside a box-like housing 11. Optionally, the box-like housing 11 may be omitted. As described in detail hereinafter, the control valve 12 of the bidet device 10 is connected to the existing cold water supply line C and hot water supply line H.

A pliant S-shaped water conduit 13 connected at one end to the control valve 12 extends under the toilet seat S, curves over the rim R of the toilet bowl B, then extends downwardly, and then curves back upwardly inside the bowl. A spray nozzle 14 is attached to the upwardly extending free end of the conduit 12. The pliant water conduit 13 may be easily manually adjusted to assume various positions, as indicated by opposed arrows in FIG. 1, and thereby direct a spray of water from the nozzle 14 to the desired target area. The control valve 12 regulates the water pressure and temperature that flows through the S-shaped water conduit 13.

Figure 2:
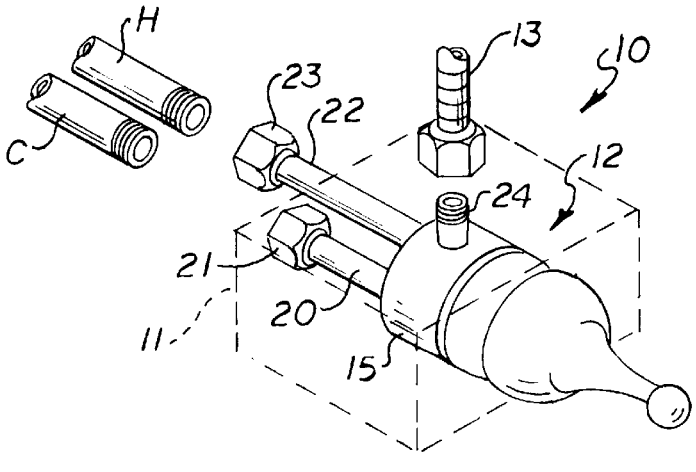
FIG. 2 is a perspective view of a preferred embodiment of the faucet-like control valve of the bidet device showing the outer housing in dashed line.
Figure 3:
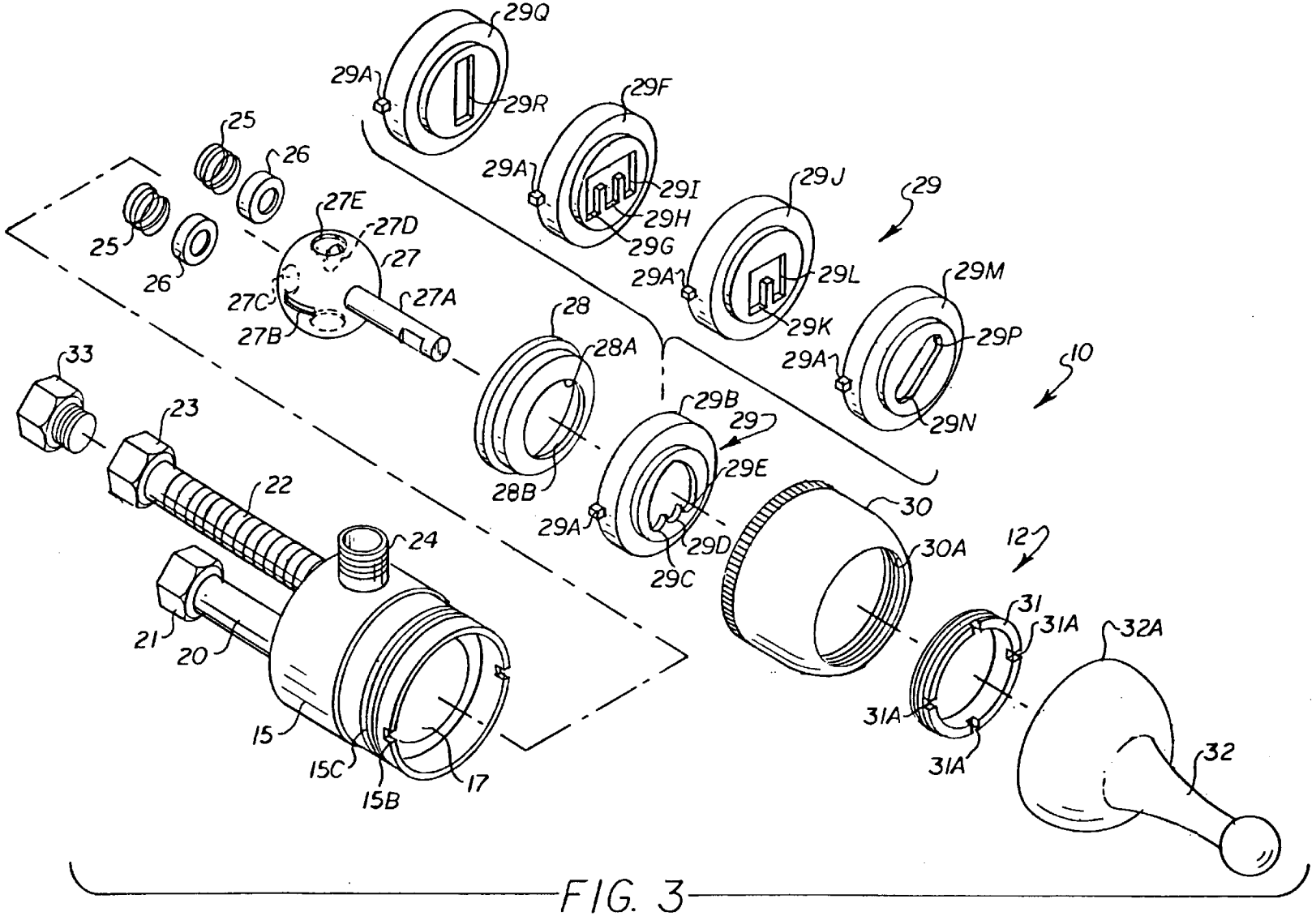
FIG. 3 is an exploded isometric view showing the components of the control valve in an unassembled condition and showing various cam disc elements to allow adjustable settings for hot, warm, or cold water.
Figure 4:
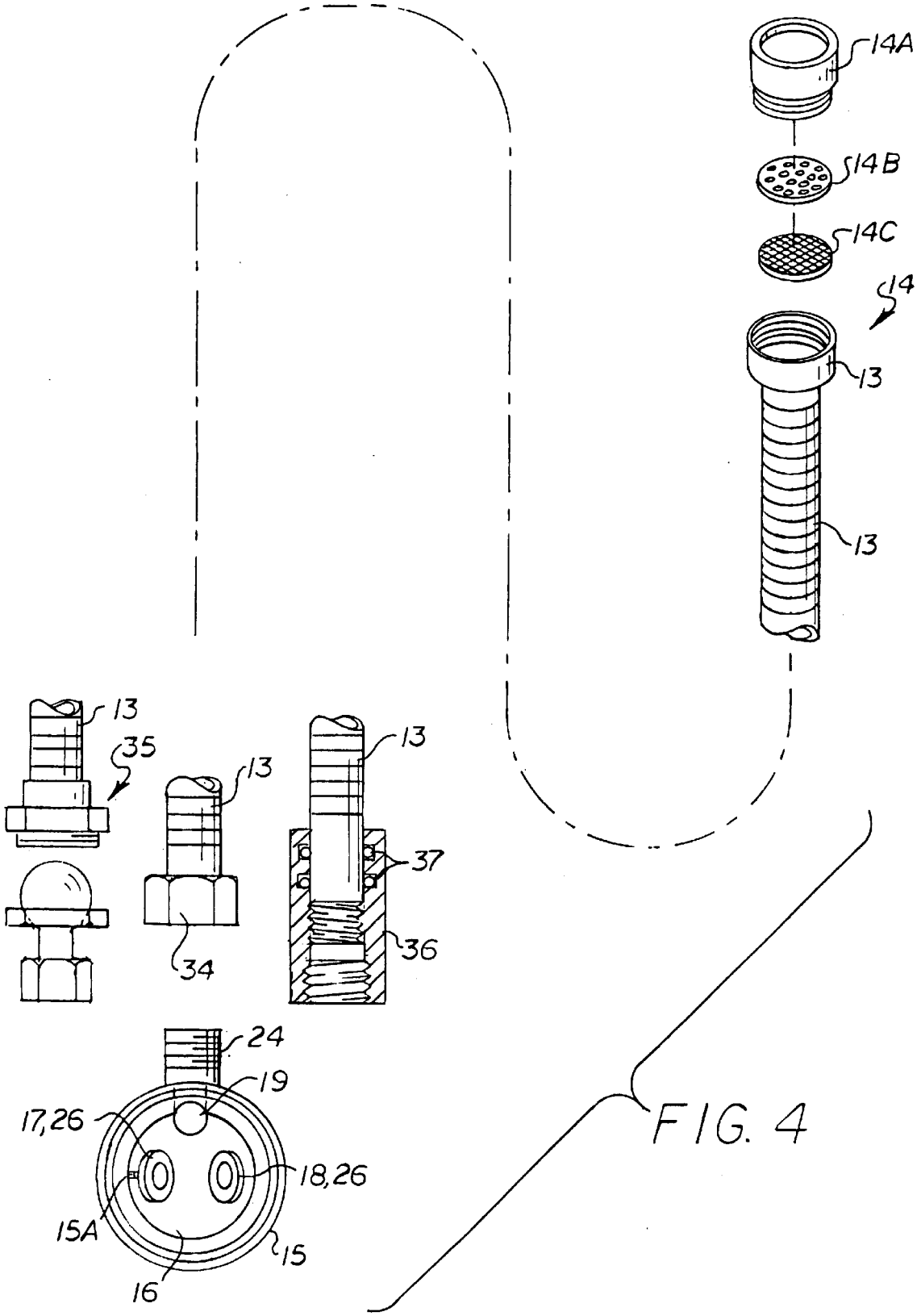
FIG. 4 is an end view of the control valve body with the valve assembly removed and showing the S-shaped water conduit with a nozzle at one end and various fittings at the other end for connecting it to the control valve.

A preferred embodiment of the control valve 12 is shown in an assembled condition in FIG. 2 and an exploded unassembled condition in FIG. 3. As best seen in FIGS. 3 and 4, the control valve assembly 12 includes a valve body 15 with a semi-spherical concave chamber 16, and an interior cold water inlet port 17, a hot water inlet port 18, and a water outlet port 19 in fluid communication with the chamber 16 (FIG. 4). A cold water inlet conduit 20 extends from the cold water inlet port 17 and has a fitting such as a compression nut fitting 21 which connects to the existing cold water supply line C. A hot water inlet conduit 22 (FIG. 3) extends from the hot water inlet port 18 (FIG. 4) and has a fitting such as a compression nut fitting 23 which connects to the existing hot water supply line H. A water outlet nipple 24 in fluid communication with the water outlet port 19 extends outwardly from the side wall of the valve body 15.

A ball valve assembly is installed in the semi-spherical concave chamber 16 of the valve body 15. The valve assembly includes a pair of springs 25 and rubber valve seats 26, one set of each installed in the cold and hot inlet ports 17 and 18. A hollow ball valve 27 having an outwardly extending stem 27A is rotatably mounted in the semi-spherical chamber 16. The ball valve has a slot 27B, a cold water aperture 27C, a hot water aperture 27D and a water outlet aperture 27E formed in its side wall. The slot 27B in the side wall of the ball valve 27 is received on an inwardly protruding pin 15A on the interior of the valve body 15 (FIG. 4) to allow the ball valve to rotate and thereby control flow through the apertures in its side wall, as explained hereinafter.

A seal disc 28 having a central opening 28A and a concave inner surface 28B is received in the valve body and engages the ball valve 27 with the stem 27A of the ball valve extending through the opening. A selected disc-shaped cam member, designated generally as 29, is installed on the seal disc 28 and has an outwardly protruding tab 29A which is received in a slot 15B formed in the valve body 15. A cup-shaped cap 30 having internal threads at one end is threadedly engaged on external threads 15C formed on the valve body 15 (FIG. 3) and has an internally threaded bore 30A at its opposite end. The cap 30 holds all the components together. A hollow cylindrical externally threaded seal insert 31 is threadedly received in the threaded bore 30A of the cap 30 and engages the cam member 29 to apply a compressive force to the assembled components to effect a water-tight seal sealing relation. The sealing force can be adjusted by tightening or loosening the insert 31 with a tool (not shown) which is received in circumferentially spaced slots 31A in the outer end of the insert. The stem 27A of the ball valve 27 extends through the cam member 29 and the insert 31. A handle 32 having a concave cup-shaped base 32A is secured to the stem 27A and the cup shaped base overlaps the outer end of the cap 30.

When the ball valve 27 is rotated by moving the handle to the left or right, its cold and hot apertures 27C and 27D pass across the cold and hot water inlet ports 17 and 18 in the valve body 15 allowing them to be closed, partially opened, or fully opened and the water is mixed inside the hollow spherical ball. When the handle is moved up or down, the water outlet 27E passes across the water outlet port 19 in the valve body allowing it to be closed, partially opened, or fully opened, thereby adjusting the water pressure of the discharged water.

FIG. 3 shows various interchangeable cam members 29 having different apertures which may be used to allow the ball valve to be pre-set or positioned to provide the desired water pressure and to supply water of hot, warm, or cold temperatures. One cam member 29B has a central aperture with three adjacent curved recesses 29C, 29D, and 29E at its lower end. Alternatively, as represented by 29F, the central aperture may be formed of three adjacent slots 29G, 29H, and 29I joined together at their upper ends. In these cam embodiments, when the stem 27A is in the left-hand recess 29C or slot 29G, only cold water is provided, when in the central slot 29D or recess 29H the hot water mixes with the cold water to provide warm water, and when in the right-hand recess 29E or slot 29I, only hot water is provided. When the stem 27A is in the upper end of the recesses or slots, the water is turned off.

Another pair of cam members 29J and 29M each have a central aperture through which the stem 27A of the ball valve 27 passes that allows the ball valve to be pre-set or positioned to supply water of only hot or cold temperatures. As represented by numeral 29J, the apertured cam disc may have two adjacent straight sided parallel slots 29K and 29L joined at their upper ends, or, as represented by numeral 29M, may have an oval-shaped recess with rounded ends 29N and 29P. When the stem 27A is in the left-hand slot 29K or rounded end 29N cold water is produced, and when in the right-hand slot 29L or rounded end 29P hot water is produced. When the stem 27A is in the upper end of the slots or centered between the rounded ends of the oval recess, the water is turned off.

The control valve may also be installed where there is no hot water supply line or the installation of, or connection to, the hot water supply is not available or practical. In this installation, a plug 33 is provided which can be installed in the end of the hot water inlet conduit 22, and only cold water is produced. In this arrangement, the previously described cam discs may be used, or a cam disc 29Q may be provided having a single vertical slot 29R. When the stem 27A is in the upper end of the slot 29R, the cold water is turned off.

Referring again to FIG. 4, the pliant S-shaped water conduit 13 is connected at a first end to the outlet nipple 24 extending outwardly from the side wall the valve body 15. In a preferred embodiment, the pliant water conduit 13 is approximately ¼" in diameter and may be formed of a chrome-plated metal material or suitable plastic material. The first end of the water conduit 13 may be connected to the nipple 24 by a compression nut fitting 34 or, by a ball and socket type swivel connection 35, or, alternatively, by a tubular connector 36 that connects to the nipple 24 and has internal O-rings 37 that seal on the first end of the water conduit 13. As described above, the water conduit 13 extends from the control valve 12 (FIG. 2), under the toilet seat S, curves over the rim R of the toilet bowl B, then extends downwardly, and then curves back upwardly in the bowl (FIG. 1).

In the preferred embodiment, the nozzle 14 has a spray nozzle cap 14A attached to a fitting 13A on the upwardly extending free end of the conduit 13. The spray nozzle cap 14A contains a perforated disc 14B, and may also contain an interior metal screen 14C. The perforated disc 14B and screen 14C neutralize the water pressure and strain out contaminants and debris, and produces a comfortable bidet spray directed to the target area. The S-shaped water conduit 13 can be easily adjusted according to each user's particular preferences, by simply bending or shaping it by hand. It should be understood that the water conduit 13 may also be provided without the spray nozzle assembly 14.

While this invention has been described fully and completely with special emphasis upon a preferred embodiment, it should be understood that within the scope of the appended claims the invention may be practiced otherwise than as specifically described herein.

I claim:

1. A faucet-like bidet device for use in conjunction with a conventional flush toilet, comprising:

a water control valve body having a cold water inlet and a hot water inlet at one end adapted for connection to a respective existing cold water supply line and hot water supply line, a water outlet adapted for connection to a water conduit, an interior semi-spherical concave chamber in fluid communication with said cold water inlet, said hot water inlet, and said water outlet, and a valve assembly at another end of said valve body including a hollow ball valve member sealingly and rotatable mounted therein having a cold water aperture, a hot water aperture, and a water outlet aperture formed in its side wall, and a stem extending to the exterior of said valve body connected with handle means for rotating said ball member relative to said inlets and water outlet to selectively fully open, partially open, or close, and regulate the pressure of cold and hot water flow through said water outlet and said water conduit, and to mix said hot and cold water, whereby hot, cold or warm water may be selected to flow through said outlet and said water conduit in installations where there is an existing hot water supply line;

upon rotation of said ball valve member about a horizontal axis, said cold water aperture and said hot water aperture are in fluid communication with said cold water inlet and said hot water inlet, respectively, and said water outlet aperture moves across said water outlet allowing it to be selectively closed, partially opened, or fully opened to regulate the pressure of hot and cold water flow through said water outlet and said water conduit;

an accessory plug adapted to be removably installed in said hot water inlet whereby said hot water inlet may be selectively plugged for installations where there is no existing hot water supply line, such that said valve and handle means is operative to regulate the pressure of cold water flow through said outlet and said water conduit;

a pliable tubular water conduit connected at one end to said water outlet capable of being manually shaped by hand to extend beneath the toilet seat of the toilet, curved over the rim of the toilet bowl, and downwardly therefrom, and its opposed end curved back upwardly inside the toilet bowl in a generally S-shaped configuration to direct discharged water onto the anal and genital areas of a user; and said pliable tubular water conduit characterized as capable of being adjustably shaped by hand to direct the discharged water to a desired area and assume various positions according to the particular preferences of said user.

2. The faucet-like bidet device according to claim 1, further comprising an outer housing substantially enclosing said valve body with said cold water inlet, said hot water inlet, and said handle means disposed exterior of said housing.

3. The faucet-like bidet device according to claim 1, further comprising nozzle means on said pliable tubular water conduit upwardly curved end for discharging water as a spray.

4. The faucet-like bidet device according to claim 3, wherein said nozzle means includes a perforated disc having perforations to reduce the pressure of the discharged water such that it is discharged as a soft spray; and a mesh screen strainer having a mesh size sufficient to prevent passage of debris.

5. The faucet-like bidet device according to claim 1, wherein said one end of said pliable tubular water conduit has a generally tubular connector with internal O-rings sealingly engaged thereon and said tubular connector is connected to said water outlet.

6. The faucet-like bidet device according to claim 1, wherein said one end of said pliable tubular water conduit is connected to said water outlet by a compression nut fitting connection.

7. The faucet-like bidet device according to claim 1, wherein said one end of said pliable tubular water conduit is connected to said water outlet by a ball and socket connection.

8. The faucet-like bidet device according to claim 1, wherein upon rotation of said ball valve member about a horizontal axis, said cold water aperture and said hot water aperture are in fluid communication with said cold water inlet and said hot water inlet, respectively, and said water outlet aperture moves across said water outlet allowing it to be selectively closed, partially opened, or fully opened to regulate the pressure of hot and cold water flow through said water outlet and said water conduit; and upon rotation of said ball valve member about a vertical axis, said water outlet aperture is in fluid communication with said water outlet, and said cold water aperture and said hot water aperture move across said cold water inlet and said hot water inlet, respectively, allowing them to be selectively closed, partially opened, or fully opened to mix said hot and cold water, whereby hot, cold or warm water may be selected to flow through said water outlet and said water conduit.

* * * * *